US009302823B2

(12) United States Patent
Rudd et al.

(10) Patent No.: US 9,302,823 B2
(45) Date of Patent: Apr. 5, 2016

(54) DRAWSTRING BAG

(71) Applicant: AEP Industries Inc., South Hackensack, NJ (US)

(72) Inventors: David Rudd, Lake George, NY (US); David Cron, Ho Ho Kus, NJ (US); Michael J. Finnegan, Haskell, NJ (US)

(73) Assignee: AEP Industries Inc., South Hackensack, NJ (US)

( * ) Notice: Subject to any disclaimer, the term of this patent is extended or adjusted under 35 U.S.C. 154(b) by 0 days.

(21) Appl. No.: 14/321,566

(22) Filed: Jul. 1, 2014

(65) Prior Publication Data

US 2015/0016754 A1 Jan. 15, 2015

Related U.S. Application Data

(60) Provisional application No. 61/842,728, filed on Jul. 3, 2013.

(51) Int. Cl.
*B65D 33/28* (2006.01)
*B65D 33/00* (2006.01)

(52) U.S. Cl.
CPC ..... *B65D 33/28* (2013.01); *B65D 33/004* (2013.01)

(58) Field of Classification Search
CPC ..... B65D 33/28
USPC ..... 383/75
See application file for complete search history.

(56) References Cited

U.S. PATENT DOCUMENTS 3,010,640 A * 11/1961 Kugler ..... 383/75
3,029,853 A * 4/1962 Piazze ..... 383/75
3,738,567 A * 6/1973 Ruda ..... 383/75
5,265,962 A 11/1993 Ogawa et al.
6,966,697 B2 11/2005 Patridge et al.
7,458,925 B2 * 12/2008 Turvey ..... 493/213
1,022,906 A1 9/2011 Bertrand et al.
8,157,444 B2 4/2012 Broering et al.
2010/0040309 A1 2/2010 Wood
2010/0046860 A1 * 2/2010 Kent et al. ..... 383/75

(Continued)

FOREIGN PATENT DOCUMENTS

CA 2727869 A1 9/2011
DE 19636511 A1 * 3/1998 ..... B65D 33/28

OTHER PUBLICATIONS

Machine translation of German Document No. 196 36 511 specification. Translated on May 26, 2015.*

(Continued)

*Primary Examiner* — Jes F Pascua
(74) *Attorney, Agent, or Firm* — Honigman Miller Schwartz and Cohn LLP

(57) ABSTRACT

An apparatus includes first and second panels continuously joined along a first side edge, a second side edge and a bottom edge. A top portion of the respective first and second side panels defines an opening of the bag. A pair of hems each extend along the top portion of the bag. Drawstrings are enclosed within respective ones of the hems and short seals are provided to weld the first panel, the second panel, and respective ends of the drawstrings together. The short seals are each located proximate to respective ones of the side edges. A first reduced opening seal is provided to weld the first panel, the second panel, and the drawstrings together. The first reduced opening seal is located adjacent to the first side edge and includes a convex polygonal shape.

19 Claims, 2 Drawing Sheets

(56) References Cited

U.S. PATENT DOCUMENTS

| | | | | |
|---|---|---|---|---|
| 2010/0111452 | A1 | 5/2010 | Ross | |
| 2010/0247002 | A1 | 9/2010 | Ross | |
| 2011/0064333 | A1 | 3/2011 | Ross | |
| 2011/0075952 | A1 * | 3/2011 | Mallory | 383/75 |

OTHER PUBLICATIONS

Machine translation of German Document No. 196 36 511 claims. Translated on May 26, 2015.*

Canadian Office Action for the related application No. 2,855,465 dated Jun. 22, 2015.

* cited by examiner

DRAWSTRING BAG

CROSS REFERENCE TO RELATED APPLICATIONS

This U.S. patent application claims the benefit of U.S. Provisional Application 61/842,728, filed on Jul. 3, 2013. The disclosure of this prior application is considered part of the disclosure of this application and is hereby incorporated by reference in its entirety.

TECHNICAL FIELD

This disclosure relates to the construction and manufacture of plastic bags. Specifically, the present disclosure relates to improvements in the construction and manufacture of drawstring trash bags.

BACKGROUND

Drawstring trash bags, which incorporate drawstrings into the bag design, are a popular alternative to twist-tie or flapped trash bags. Conventional drawstring trash bags include a pair of drawstrings enclosed within hems running along an opening of the trash bag. The ends of the drawstrings are physically joined to the bag by seals welding the drawstrings to the panels of the bag allowing users to pull the drawstrings through access cut-outs in the respective hems. The pulled drawstrings may then be tied together to securely close the bag while also providing a convenient handle for carrying the bag.

Conventional drawstring trash bags suffer from being able to be secured in place when pulled over an upper rim of a receptacle. As a result, when trash is placed into the receptacle, the force on the bag as the trash falls into the bag and the overall weight of the trash already in the bag tends to pull the sides of the conventional trash bag into the trash can.

It is known to utilize elastic materials for the drawstrings, or drawstrings which otherwise exhibit elastic-like properties, for securing the bag on a trash receptacle. It is further known to utilize the elastic drawstrings in combination with multiple seals to provide a reduced opening in the bag.

SUMMARY

One aspect of the disclosure provides a bag including first and second panels continuously joined along a first side edge, a second side edge and a bottom edge. A top portion of the respective first and second side panels defines an opening of the bag. A first hem of the first panel and a second hem of the second panel each extend along the top portion of the bag from the first side edge to the second side edge. A first drawstring is enclosed within the first hem and a second drawstring is enclosed within the second hem. The first and second drawstrings each having a respective first end adjacent to the first side edge and a respective second end adjacent to the second side edge. A first short seal is provided to weld the first panel, the second panel, the first end of the first drawstring, and the first end of the second drawstring together. A second short seal is provided to weld the first panel, the second panel, the second end of the first drawstring, and the second end of the second drawstring together. The first short seal is located proximate to the first side edge of the bag and the second short seal is located proximate to the second side edge of the bag. A first reduced opening seal is provided to weld the first panel, the second panel, the first drawstring, and the second drawstring together. The first reduced opening seal is located adjacent to the first side edge and includes a convex polygonal shape.

Implementations of the disclosure may include one or more of the following features. In some implementations, the first reduced opening seal is located adjacently inward from the first short seal. In some implementations the convex polygonal shape of the first reduced opening seal includes a six-sided parallelogram. The six-sided parallelogram includes a body portion that is a quadrilateral, a first end portion extending from the body portion in a direction toward the top portion of the bag, and a second end portion extending from the body portion in a direction opposite from the first end portion and toward the bottom edge of the bag. The first and second end portion each including two respective sides each formed by an angle from the body portion toward a respective end portion apex. In some implementations, each of the first and second end portions include a width that is less than a width of the body portion.

In other implementations, the convex polygonal shape of the first reduced opening seal includes an equiangular polygon. In even yet another implementation, the convex polygonal shape of the first reduced opening seal includes a triangular polygon.

Implementations of the disclosure may further include a second reduced opening seal provided to weld the first panel, the second panel, the first drawstring, and the second drawstring together. The second reduced opening seal is located adjacent to the second side edge and comprising the convex polygonal shape. In some implementations, the second reduced opening seal is located adjacently inward from the second short seal. In some implementations the convex polygonal shape of the second reduced opening seal includes a six-sided parallelogram. In other implementations, the convex polygonal shape of the second reduced opening seal includes an equiangular polygon. In even yet another implementation, the convex polygonal shape of the second reduced opening seal includes a triangular polygon.

In some implementations the convex polygonal shape of at least one of the first and second reduced opening seals includes an indicia including at least one of letters, numbers and symbols that are visible when the bag is placed over an upper rim of a trash receptacle. In some implementations, the indicia includes a recycling symbol. In some implementations, the indicia is embossed within an inside of at least one of the first and second reduced opening seals to provide an improved tactile feel when a consumer grips the bag.

The details of one or more implementations of the disclosure are set forth in the accompanying drawings and the description below. Other aspects, features, and advantages will be apparent from the description and drawings, and from the claims.

DESCRIPTION OF DRAWINGS

The following figures are provided by way of example and are not intended to limit the scope of the present disclosure.

Like reference symbols in the various drawings indicate like elements.

DETAILED DESCRIPTION

Figure 1:
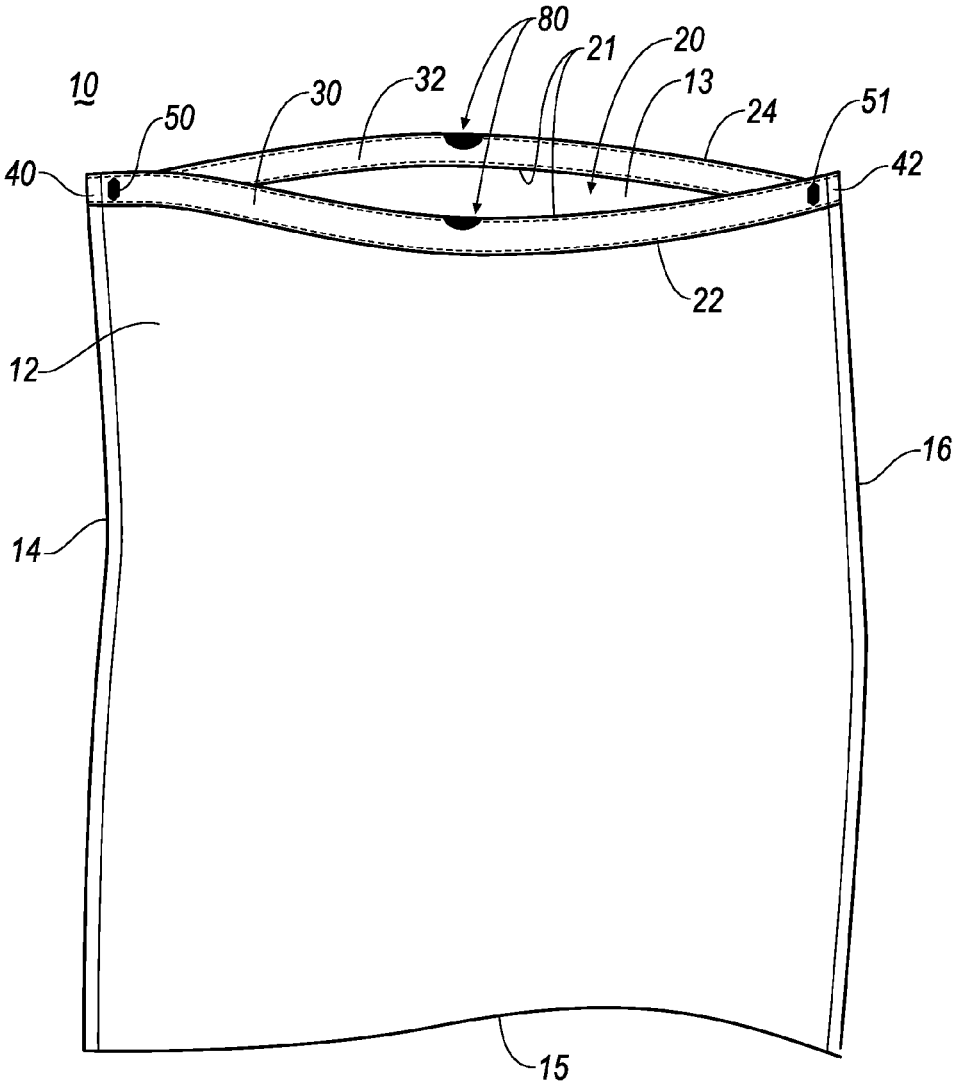
FIG. 1 is an elevational view of a drawstring bag, in accordance with the present disclosure.

FIG. 1 illustrates an exemplary implementation of an elevational view of a drawstring bag 10, in accordance with the present disclosure. In some implementations, the drawstring bag 10 may include a drawstring trash bag that fits over an upper rim of a trash receptacle for receiving and storing trash and debris. The bag includes first and second panels 12 and 13, respectively, continuously coupled or joined along a first side edge 14, a second side edge 16 and a bottom edge 15. An opening 20 of the bag 10 is formed at a top portion 21 of the first panel 12 and the second panel 13. Specifically, the top portion of the respective first and second side panels 12, 13, respectively, defines the opening 20 of the bag 10. The length of the bag is the distance between the bottom edge 15 and the top portion 21. The width of the bag is the distance between the first and second side edges 14, 16, respectively. A first hem 22 of the first panel 12 extends along the top portion 21 of the bag 10 from the first side edge 14 to the second side edge 16. A second hem 24 of the second panel 13 extends along the top portion 21 from the first side edge 14 to the second side edge 16. A first drawstring 30 is enclosed within the first hem 22 and a second drawstring 32 is enclosed within the second hem 24. The drawstrings may include materials that exhibit elastic properties. Respective first ends of the drawstrings 30 and 32 are adjacent to the first side edge 14 and respective second ends of the drawstrings 30 and 32 are adjacent to the second side edge 16.

The ends of the drawstrings 30 and 32 may be anchored to upper corners of the bag 10 to make the drawstrings 30 and 32 useful. As used herein, the term "upper corners" refer to a first upper corner whereat the first side edge 14 and the first and second panels 12, 13, respectively, intersect; and a second upper corner whereat the second side edge 16 and the first and second side panels 12, 13, respectively, intersect. To anchor the drawstrings 30 and 32 to the first upper corner, a first short seal 40 is provided to weld the first and second panels 12, 13, respectively, and the respective first ends of the drawstrings 30 and 32 together. In the illustrated example, the first short seal 40 is located adjacent to, and inward from, the first side edge 14. To anchor the drawstrings 30 and 32 to the second upper corner, a second short seal 42 is provided to weld the first and second panels 12, 13, respectively, and the respective second ends of the drawstrings 30 and 32 together. In the illustrated example, the second short seal 42 is located adjacent to, and inward from, the second side edge 16. The short seals 40 and 42 must be sufficiently strong enough to securely hold the ends of the drawstrings 30 and 32 together while a user pulls the drawstrings 30 and 32 through centrally-located cut-outs 80. Here, as the drawstrings 30 and 32 are pulled through the cut-outs 80, the opening 20 of the bag 10 closes, securing the trash and debris within the bag 10.

Exemplary implementations of the present disclosure are directed toward utilizing first and second reduced opening seals 50 and 51 to reduce the opening 20 of the bag 10. Each of the first and second reduced opening seals 50 and 51 has a polygonal shape formed by straight line segments. Specifically, each of the reduced opening seals 50 and 51 has a convex polygonal shape. As used herein, the term "convex polygonal shape" refers to a polygon that is indicative of having interior angles that are all less than 180°. When combined with the drawstrings 30 and 32 having elastic properties, the reduced opening 20 of the bag 10 can be stretched to overlap the upper rim of a trash receptacle. Each of the reduced opening seals 50 and 51 are located within the first and second hem regions 22, 24, respectively, welding the drawstrings 30 and 32 and the panels 12 and 13 together in a similar manner as the short seals 40 and 42. In some implementations, the first reduced opening seal 50 is positioned proximate to—and adjacently inward from—the first short seal 40. In other implementations, the first reduced opening seal 50 is positioned adjacent to the first side edge 14. In some implementations, the second reduced opening seal 51 is positioned proximate to—and adjacently inward from—the second short seal 42. In other implementations, the second reduced opening seal 51 is positioned adjacent to the second side edge 16.

Figure 2:
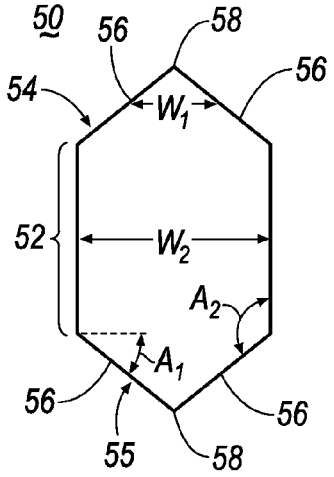
FIG. 2 is an exemplary implementation of an enlarged view of a first reduced opening seal formed in the drawstring bag of FIG. 1 and having a convex polygonal shape that is a six-sided parallelogram, in accordance with the present disclosure.

Referring to FIG. 2, an exemplary implementation of an enlarged view of the first reduced opening seal 50 of FIG. 1 having the convex polygonal shape that is a six-sided parallelogram is illustrated. In the illustrated example, the convex polygon seal 50 is a hexagon. While the enlarged view of the first reduced opening seal 50 is depicted in FIG. 2, the second reduced opening seal 51 will be understood to include the same features. In the illustrated example, the hexagonal seal 100 is formed by straight line segments. The first reduced opening seal 50 includes a body portion 52, a first end portion 54 and a second end portion 55. The body portion 52 includes a quadrilateral having a width W2 that may be a square in some implementations or may be a rectangle in other implementations. The first end portion 54 extends from the body portion 52 in the lengthwise direction toward the top portion 21 of the bag 10 and the second end portion 55 extends from the body portion 52 in the lengthwise direction toward the bottom edge 15 of the bag 10. The end portions 54 and 55 are defined by sides 56 that are formed by an angle A1 from the body portion 52 toward an apex 58. For instance, angle A1 can be equal to 45° in the illustrated non-limiting example. Thus, in the illustrated non-limiting example, an interior angle A2 between the side 56 and a side of the body portion 52 is equal to 135° when angle A1 is equal to 45°. The end portions 54 and 55 have a width W1 that may be less than the width W2 of the body portion 52. In other implementations, the reduced opening seals 50 and 51 can have a varied shape.

Figure 3:
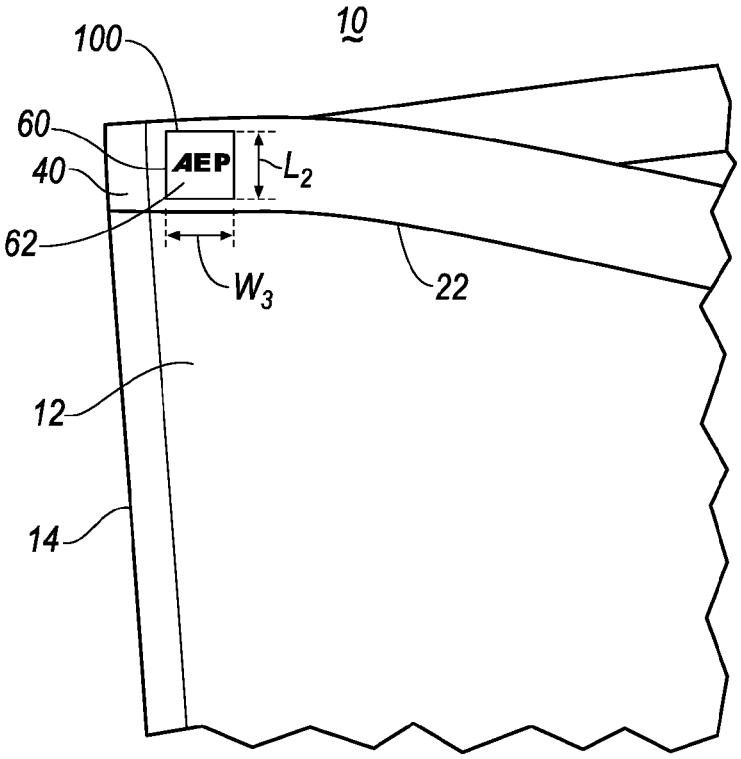
FIG. 3 illustrates another exemplary implementation of a reduced opening seal formed in the drawstring bag of FIG. 1 at a first upper corner and having a convex polygonal shape that is equiangular, in accordance with the present disclosure.

FIG. 3 illustrates another exemplary implementation of a reduced opening seal 100 formed in the bag 10 of FIG. 1 at the first upper corner and having the convex polygonal shape that is equiangular, in accordance with the present disclosure. The reduced opening seal 100 in the illustrated non-limiting example is an equiangular polygon (e.g., a quadrilateral) having a width $W_3$ and a length $L_2$ that may include a square in some implementations or may include a rectangle in other implementations. The reduced opening seal 100 may replace the six-sided parallelogram first reduced opening seal 50 of FIGS. 1 and 2. An additional reduced opening seal 100 having the polygonal shape that is convex may be formed in the drawstring bag 10 of FIG. 1 at the second upper corner to replace the second reduced opening seal 51. In some implementations, the reduced opening seal 100 includes indicia 60. For instance, the indicia 60 may include letters, numbers or symbols. In some implementations, the indicia 60 can be embossed within an inside 62 of the reduced opening seal 100. Accordingly, when the bag 10 is folded over the upper rim of the trash receptacle, the embossed indicia 60 will be visible from the outside of the receptacle resulting in a bag with more desirable physical characteristics. Moreover, the embossed indicia 60 within the inside 62 of the reduced opening seal 100 provides a better tactile feel for the consumer when the consumer grips the bag 10 for placing it over the outside rim of the trash receptacle.

Figure 4:
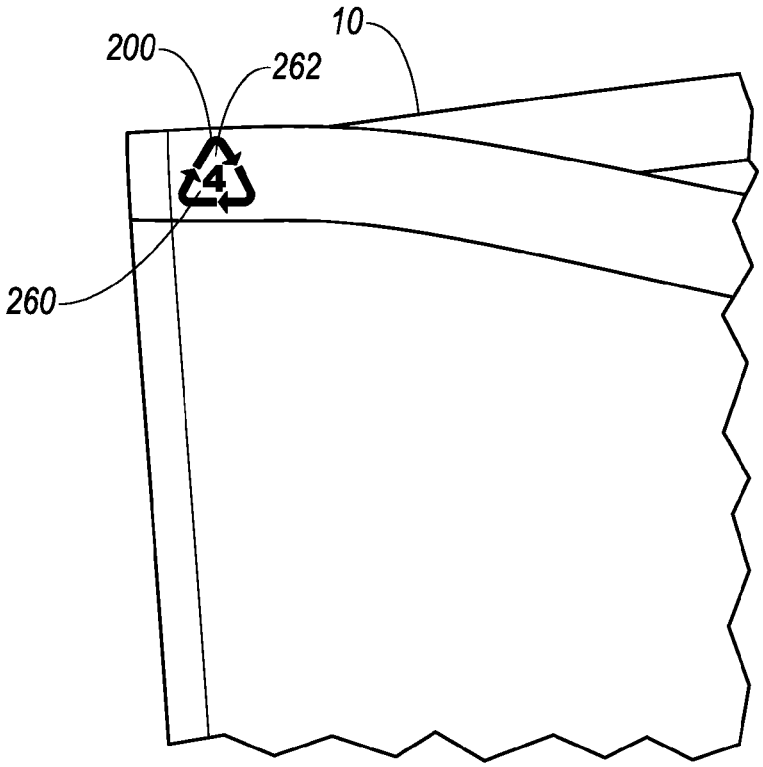
FIG. 4 is another exemplary implementation of a reduced opening seal formed in the drawstring bag of FIG. 1 at a first upper corner and having a convex polygonal shape that is triangular, in accordance with the present disclosure.

FIG. 4 illustrates another exemplary implementation of a reduced opening seal 200 formed in the drawstring bag of FIG. 1 at the first upper corner and having the convex polygonal shape that is triangular, in accordance with the present disclosure. The reduced opening seal 200 may replace the six-sided parallelogram first reduced opening seal 50 of FIGS. 1 and 2. An additional reduced opening seal 200 having the polygonal shape that is triangular may be formed in the drawstring bag 10 of FIG. 1 at the second upper corner to replace the second reduced opening seal 51. In some implementations, the reduced opening seal 200 includes indicia 260. For instance, the indicia 260 may include letters, numbers or symbols. In the illustrated non-limiting example, the indicia 260 includes a recycling symbol included within the reduced opening seal 200. In this instance, when the bag 10 is placed over the upper rim of the trash receptacle, the indicia 260 including the recycling symbol can serve as a notification for the consumer that the bag 10 is met for recyclable debris. In some implementations, the indicia 260 can be embossed within an inside 262 of the reduced opening seal 100 and/or at a perimeter of the reduced opening seal 200. In this instance, the embossed indicia 260 provides a better tactile feel for the consumer when the consumer grips the bag 10 for placing it over the outside rim of the trash receptacle. Further, at least one of the reduced opening seals 50 and 51 of FIG. 1 can include indicia that may be embossed therein as described herein with reference to the exemplary implementations of FIGS. 3 and 4.

A number of implementations have been described. Nevertheless, it will be understood that various modifications may be made without departing from the spirit and scope of the disclosure. Accordingly, other implementations are within the scope of the following claims.

What is claimed is:

1. An apparatus, comprising:

a bag comprising first and second panels continuously joined along a first side edge, a second side edge and a bottom edge;

a top portion of the respective first and second side panels defining an opening of the bag;

a first hem of the first panel extending along the top portion of the bag from the first side edge to the second side edge;

a second hem of the second panel extending along the top portion of the bag from the first side edge to the second side edge;

a first drawstring enclosed within the first hem having a first end adjacent to the first side edge and a second end adjacent to the second side edge;

a second drawstring enclosed within the second hem having a first end adjacent to the first side edge and a second end adjacent to the second side edge;

a first short seal provided to weld the first panel, the second panel, the first end of the first drawstring, and the first end of the second drawstring together, the first short seal is located proximate to the first side edge of the bag;

a second short seal provided to weld the first panel, the second panel, the second end of the first drawstring and the second end of the second drawstring together, the second short seal is located proximate to the second side edge of the bag; and a first reduced opening seal provided to weld the first panel, the second panel, the first drawstring, and the second drawstring together, the first reduced opening seal located adjacent to the first side edge and comprising a convex polygonal shape, wherein the first reduced opening seal comprises an indicia including a recycling symbol that is visible when the bag is placed over an upper rim of a trash receptacle.

2. The apparatus of claim 1, wherein the first reduced opening seal is located adjacently inward from the first short seal.

3. The apparatus of claim 1, wherein the convex polygonal shape of the first reduced opening seal comprises a six-sided parallelogram.

4. The apparatus of claim 1, wherein the convex polygonal shape of the first reduced opening seal comprises an equiangular polygon.

5. The apparatus of claim 1, wherein the convex polygonal shape of the first reduced opening seal comprises a triangular polygon.

6. The apparatus of claim 1, further comprising:

a second reduced opening seal provided to weld the first panel, the second panel, the first drawstring, and the second drawstring together, the second reduced opening seal located adjacent to the second side edge and comprising a convex polygonal shape.

7. The apparatus of claim 6, wherein the second reduced opening seal is located adjacently inward from the second short seal.

8. The apparatus of claim 6, wherein the convex polygonal shape of the first reduced opening seal comprises a six-sided parallelogram.

9. The apparatus of claim 6, wherein the convex polygonal shape of the first reduced opening seal comprises an equiangular polygon.

10. The apparatus of claim 6, wherein the convex polygonal shape of the first reduced opening seal comprises a triangular polygon.

11. An apparatus including a bag having first and second panels continuously joined along a first side edge, a second side edge and a bottom edge, comprising:

a top portion of the respective first and second side panels defining an opening of the bag;

a pair of hems each respective to corresponding ones of the first and second panels and extending along the top portion of the bag from the first side edge to the second side edge;

a pair of drawstrings each enclosed within corresponding ones of the pair of hems and having a respective first end adjacent to the first side edge and a respective second end adjacent to the second side edge;

a first short seal provided to weld the first panel, the second panel, and the respective first ends of the pair of drawstrings together, the first short seal is located proximate to the first side edge of the bag;

a second short seal provided to weld the first panel, the second panel, and the respective second ends of the pair of drawstrings together, the second short seal is located proximate to the second side edge of the bag; and first and second reduced opening seals each having a convex polygonal shape comprising: the first reduced opening seal welding the first panel, the second panel, and the respective first ends of the pair of drawstrings, the first reduced opening seal is located adjacently inward from the first short seal, and the second reduced opening seal welding the first panel, the second panel, and the pair of drawstrings, the second reduced opening seal is located adjacently inward from the second short seal, wherein the convex polygonal shape of at least one of the first and second reduced opening seals comprises an indicia including a recycling symbol that is visible when the bag is placed over an upper rim of a trash receptacle.

12. The apparatus of claim 11, wherein the convex polygonal shape of at least one of the first and second reduced opening seals comprises a six-sided parallelogram.

13. The apparatus of claim 12, wherein the six-sided parallelogram comprises:

a body portion comprising a quadrilateral;

a first end portion extending from the body portion in a direction toward the top portion of the bag, the first end portion including two sides each formed by an angle from the body portion toward a first end portion apex;

a second end portion extending from the body portion in a direction opposite from the first end portion and toward the bottom edge of the bag, the second end portion including two sides each formed by an angle from the body portion toward a second end portion apex.

14. The apparatus of claim 13, wherein each of the first and second end portions include a width that is less than a width of the body portion.

15. The apparatus of claim 11, wherein the convex polygonal shape of at least one of the first and second reduced opening seals comprises an equiangular polygon.

16. The apparatus of claim 11, wherein the convex polygonal shape of at least one of the first and second reduced opening seals comprises a triangular polygon.

17. The apparatus of claim 11, wherein the indicia includes at least one of letters, numbers and symbols that are visible when the bag is placed over an upper rim of a trash receptacle.

18. The apparatus of claim 17, wherein the indicia is embossed within an inside of at least one of the first and second reduced opening seals to provide an improved tactile feel when a consumer grips the bag.

19. The apparatus of claim 11, wherein the pair of drawstrings exhibit elastic properties.

* * * * *